US006694971B2

(12) United States Patent
Schroeder

(10) Patent No.: US 6,694,971 B2
(45) Date of Patent: Feb. 24, 2004

(54) FACE MASK

(76) Inventor: Guy Daniel Schroeder, 8680 Highway 193, New Castle, CA (US) 95658

( * ) Notice: Subject to any disclaimer, the term of this patent is extended or adjusted under 35 U.S.C. 154(b) by 157 days.

(21) Appl. No.: 09/939,452

(22) Filed: Aug. 25, 2001

(65) Prior Publication Data

US 2003/0037787 A1 Feb. 27, 2003

(51) Int. Cl.[7] ..... A62B 18/08
(52) U.S. Cl. ..... 128/201.14; 128/206.19
(58) Field of Search ..... 128/201.12, 201.14, 128/201.25, 205.27, 206.19; 2/9, 173, 206

(56) References Cited

U.S. PATENT DOCUMENTS 2,342,982 A * 2/1944 Stern et al. ..... 2/9
2,446,530 A * 8/1948 Grazia et al. ..... 2/173
2,448,021 A * 8/1948 Grazia ..... 2/205
2,462,005 A * 2/1949 Schauweker ..... 128/207.11
2,529,106 A * 11/1950 Schauweker ..... 128/201.25
2,583,304 A * 1/1952 Pipher ..... 128/201.25
2,740,400 A * 4/1956 Wines ..... 128/206.17
2,762,368 A * 9/1956 Bloomfield ..... 128/206.28
2,965,902 A * 12/1960 Louch ..... 2/9
3,884,227 A * 5/1975 Lutz et al. ..... 128/206.19
4,215,682 A * 8/1980 Kubik et al. ..... 128/205.29
4,944,294 A * 7/1990 Borek, Jr. ..... 128/206.19
4,966,140 A * 10/1990 Herzberg ..... 128/206.19
5,020,533 A * 6/1991 Hubbard et al. ..... 128/206.23
5,067,174 A * 11/1991 Ritchey et al. ..... 2/10
5,107,547 A * 4/1992 Scheu ..... 2/206
5,303,423 A * 4/1994 Gazzara et al. ..... 2/9
5,383,450 A * 1/1995 Hubbard et al. ..... 128/206.23
5,406,944 A * 4/1995 Gazzara ..... 128/206.19
5,446,925 A * 9/1995 Baker et al. ..... 2/9
5,553,608 A * 9/1996 Reese et al. ..... 128/206.24
5,561,863 A * 10/1996 Carlson, II ..... 2/206
5,584,078 A * 12/1996 Saboory ..... 2/427
5,682,879 A * 11/1997 Bowers ..... 128/206.19
5,694,925 A * 12/1997 Reese et al. ..... 128/206.19
5,704,349 A * 1/1998 Hubbard et al. ..... 128/206.19
5,765,556 A * 6/1998 Brunson ..... 128/206.19
5,813,398 A * 9/1998 Baird et al. ..... 128/201.17
6,026,511 A * 2/2000 Baumann et al. ..... 2/9
6,062,220 A * 5/2000 Whitaker et al. ..... 128/206.19
6,123,077 A * 9/2000 Bostock et al. ..... 128/206.12
6,185,740 B1 * 2/2001 Zegarelli et al. ..... 2/9
6,213,125 B1 * 4/2001 Reese et al. ..... 128/857
6,216,695 B1 * 4/2001 Ruben ..... 128/206.19

* cited by examiner

*Primary Examiner*—Aaron J. Lewis
(74) *Attorney, Agent, or Firm*—Risto A. Rinne, Jr.

(57) ABSTRACT

An apparatus for the protection of a face in general, and in particular the eyes, ears, nose, and respiratory system of a user includes a flexible material that is adapted to be disposed over a portion of the face. The flexible material includes a first end of an upper band or cord that extends from one side thereof and enters into a first seam of the flexible material. The first seam extends along an upper perimeter of the flexible material under the ears and around the back of the neck of the user and to the opposite side of the flexible material. A second end of the upper cord exits from the seam and passes through a first hole in a shield, the shield being formed of a transparent material, for example, a clear plastic. The first end of the upper cord passes through a second hole in the shield. The first and second ends can be displaced with regard to the first and second holes and retain the shield in an upper position relative to the face of the user. According to a modification, a nosebridge assembly to which the upper portion of the flexible material is attached is included and a detachable lens is included wherein the detachable lens can be displaced longitudinally along the length of the upper cord either away from the face of the user or closer thereto, as desired.

21 Claims, 2 Drawing Sheets

FACE MASK

BACKGROUND OF THE INVENTION

1. Field of the Invention

The present invention, in general relates to devices that protect the eyes, ears, nose, and mouth from dust, impact, or noise and, more particularly, to face masks. These types of devices afford increased safety to the wearer and may also be generally referred to as "safety masks".

In the performance of various activities, tasks, and projects ranging from spray painting, working under conditions with dust and other particulants suspended in the air, areas in which there is flying debris such as during a grinding, drilling, or buffing operation, and during many other circumstances it is necessary to protect the eyes, ears, nose, and mouth from harm.

For example, harm can be in the form of subjecting the ear to loud noises. Harm can also be in the form of an object (i.e., a missile or projectile of any sort) striking an eye or any other portion of the face. It can also be quite harmful to inhale various particulants that may be present suspended in the air.

All of these general areas of risk are well known and there are various devices already in existence intended to help prevent these types of harm from occurring.

For example, respiratory protection ranges from simple over the nose and mouth disposable dust and pollen masks to expensive replacement canister-types of respirators.

It is important to note that these types of devices do not provide protection for the mouth or for the ears or face generally.

Goggles are available to protect the eyes and ear plugs of all types are available to protect the ears.

Unfortunately, these various types of protective devices are not conveniently available in a device that is inexpensive to use.

Other problems also exist with prior types of devices. If they are disposable, they tend to offer very limited protection and quality. If they are durable they tend to be expensive and also bulky and uncomfortable to wear (i.e., to use).

Other tasks require that more global protection of the face be provided. For example, if someone is spray painting or the like, they will want to protect as much of their face as possible from overspray.

Therefore, a face mask that offers a great variety of protection options, all of which are readily available and instantly selectable to meet the needs of the moment, is indeed a desirable device.

If this type of a device were comfortable to use, that would also be desirable.

Another problem with various types of eye protection devices (i.e., goggles) is that they do not have replaceable lenses. During use, the lenses of goggles often become abraded and their replacement is sometime warranted long before the rest of the device is worn out.

Accordingly, there is a need for an inexpensive face mask that can offer protection for the face generally, filter the air that is breathed, and is convenient to use, in particular to select which protection modalities (i.e., for the ears, eyes, mouth, etc.) are desired at any given moment. Such a face mask would provide protection for the various parts of the head and face in an "all in one" device configuration.

There is also a need to be able to replace a damaged lens on a "higher end" version of the face mask. There is also a need for a face mask that fills the niche between disposable "one time use" types of face masks and expensive canister types of respirators.

Such a device would be inexpensive enough so that it could be disposed of after a period of use and possible some re-use had occurred. Such a device would ideally offer greater protection to the face than a simple dust (i.e., pollen) mask.

There is also a need for a face mask that is more comfortable to wear, especially for extended periods of time, than are the canister types of respirators.

Clearly, such an apparatus would be an especially useful and desirable device.

2. Description of Prior Art

Face masks are, in general, known. For example, the following patents describe various types of these devices:

U.S. design Pat. No. 390,248 to Pranger, Feb. 3, 1998;

U.S. Pat. No. 4,038,979 to McCosker, Aug. 2, 1977;

U.S. Pat. No. 5,107,543 to Hansen, Apr. 28, 1992;

U.S. Pat. No. 5,193,226 to Mortenson, Mar. 16, 1993;

U.S. Pat. No. 5,214,804 to Carey et al., Jun. 1, 1993;

U.S. Pat. No. 5,446,925 to Baker et al., Sep. 5, 1995;

U.S. Pat. No. 5,634,201 to Mooring, May 27, 1997; and

U.S. Pat. No. 5,819,731 to Dyrud et al., Oct. 13, 1998.

Published foreign patent application under the PCT, international application number: WO 89/10106 for W.I.P.O. that was published on Nov. 2, 1989 was also found.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a face mask that is inexpensive to manufacture.

It is also an important object of the invention to provide a face mask that protects the eyes of the wearer.

Another object of the invention is to provide a face mask that protects the ears of the wearer.

Still another object of the invention is to provide a face mask that protects the lungs of the wearer.

Still yet another object of the invention is to provide a face mask that is useful to filter the air that is inhaled (i.e., breathed) by the wearer.

Yet another important object of the invention is to provide a face mask that is versatile to use.

Still yet another important object of the invention is to provide a face mask that can be reused.

Still one other object of the invention is to provide a face mask that is disposable after use.

Still one further object of the invention is to provide a face mask that is disposable after a prolonged and repeated use.

Still one other important object of the invention is to provide a face mask that provides for replacement of the lens.

Still one further important object of the invention is to provide a face mask that is flexible as to the type of protection that is provided during use.

Still one other valuable object of the invention is to provide a face mask that is comfortable to wear and to use.

Still one further valuable object of the invention is to provide a face mask that fills a niche between disposable one-time use dust masks and expensive and uncomfortable canister types of respirator masks.

Briefly, a face mask that is constructed in accordance with the principles of the present invention has a shield portion that includes a transparent lens which provides protection for the eyes and upper part of the face. A flexible fabric portion is attached to the shield portion and protects the nose and mouth and lower part of the face. A lower band passes in a circle around the bottom of the flexible fabric portion and secures the bottom of the flexible fabric portion around the neck of the wearer and an upper band that passes from the shield portion and extends down and around the back of the neck and back again on the other side of the face to the shield portion secures the upper portion in place. Preferably, the lower band and the upper band are adjustable in length and elastic. According to a modification, the shield portion is detachable from the lower flexible fabric portion thereby permitting use of only the lower flexible fabric portion, as desired, as well as permitting replacement of the lens.

DETAILED DESCRIPTION OF THE INVENTION

Figure 1:
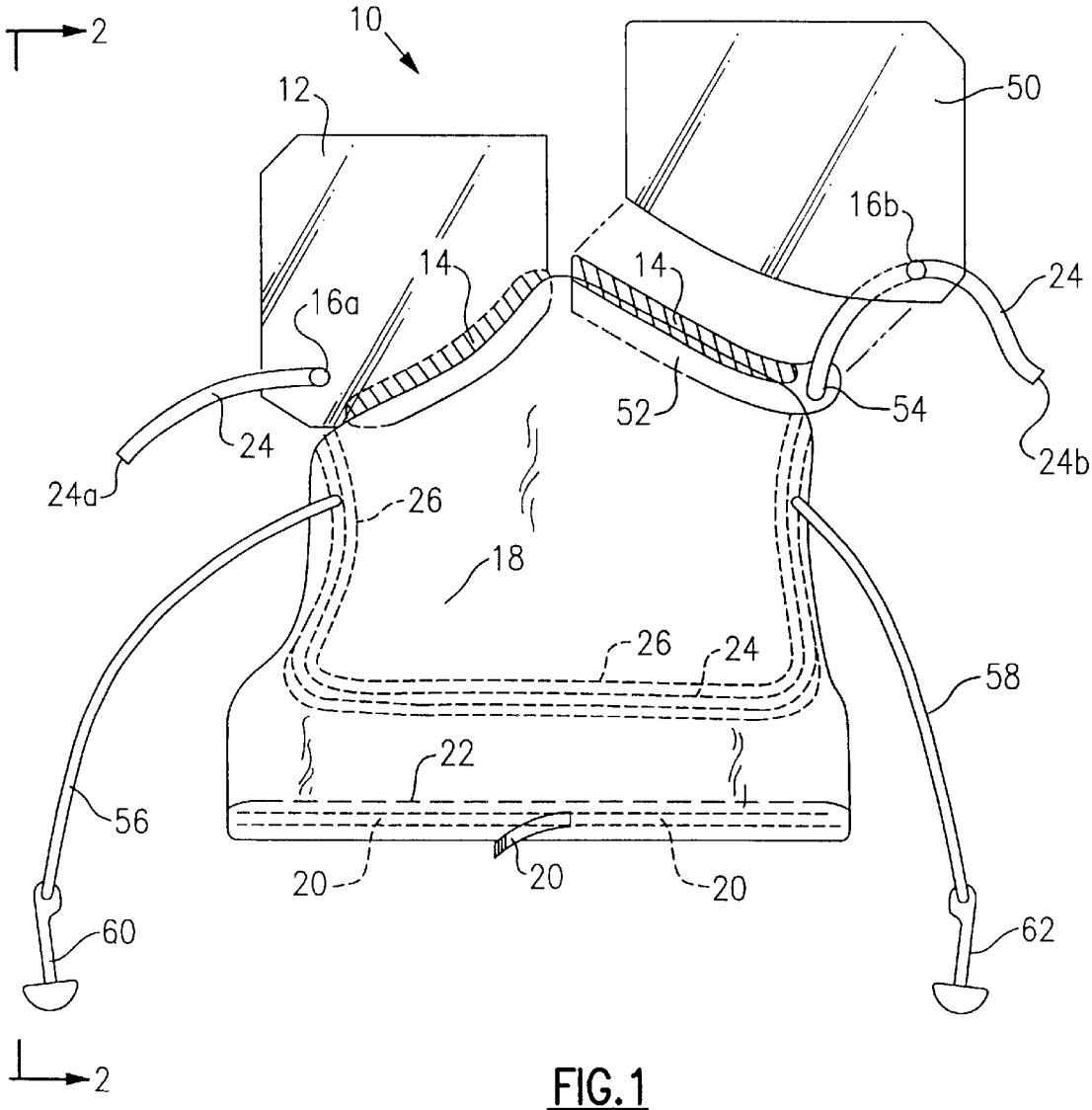
FIG. 1 is a front elevational view of a face mask on the left side of the drawing figure and of a modified face mask on the right side of the drawing figure.
Figure 2:
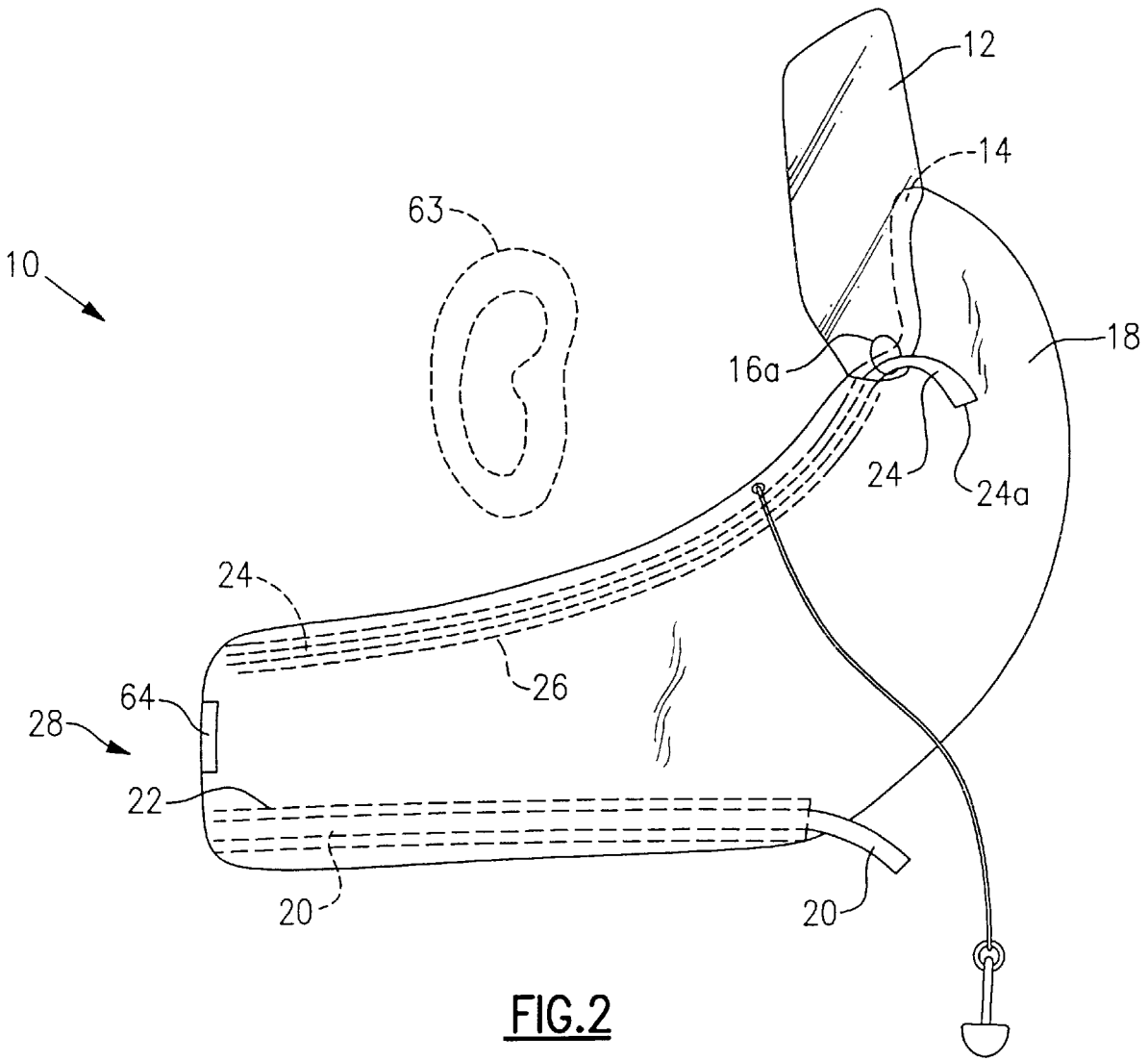
FIG. 2 is a side view of the face mask of FIG. 1 taken along the line 2—2.

Referring to FIG. 1 and FIG. 2 is shown, a safety face mask, identified in general by the reference numeral 10.

Referring to the entire drawing figure and presently primarily to the left portion of the FIG. 1 drawing, the face mask 10 includes a shield portion 12 at the top thereof.

The shield portion 12 must include at least a portion that is transparent and it is of a size and shape that is preferred as well as being constructed of a material that is preferred. Transparent types of plastic are especially well suited to form the shield portion 12 because of their resistance to impact. The exact type of plastic is selected to suit the needs of the task. For example, a harder scratch resistant type of a plastic may be required for use with tasks that are more likely to abrade the shield portion 12.

The bottom of the shield portion 12 is curved so as to form an arc that extends up and over the nose of a wearer (not shown).

Attached to the bottom of the shield portion 12 is a seal 14. The seal 14 can be a foam or a rubber strip of material or other types of material, as desired. The seal 14 provides a more effective sealing of the face mask 10 as well as a soft intermediate substance that is in direct contact with a portion of the face that is proximate the nose of the wearer.

Disposed apart on each side of the shield portion 12 is a first and second hole 16*a*, 16*b* respectively.

Attached directly to the shield portion 12 (referring now to the left side of FIG. 1 only) is a flexible fabric portion 18. The flexible fabric portion 18 acts as a filtering cloth to filter out particulants from the air.

The flexible fabric portion 18 is not attached directly to the shield portion according to a modified embodiment of the face mask 10 that is shown on the right side of the FIG. 1 drawing, and is described in greater detail hereinafter.

Any type of flexible fabric material may be used to form the flexible fabric portion 18 of the face mask 10. The finer the weave (i.e., the denser), the finer will be the size of the particulants that the face mask 10 is capable of filtering (i.e., trapping the particulants in the weave of the flexible fabric portion so as to prevent inhalation of them by the wearer).

It is also noted that the porosity of the flexible fabric portion 18 need not be uniform over its total surface area. For example, if desired, the portion in front of the mouth of the wearer may include the desired density of weave whereas the remainder of the flexible fabric portion 18 may include a different density, as desired.

By restricting the flow of air through other portions of the flexible fabric portion 18 while permitting it to occur proximate the mouth focuses the air that is breathed to pass through that area. Accordingly, it is not necessary to use the desired material to form the entire flexible fabric portion 18.

As long as the entire flexible fabric portion 18 is flexible, the restricted use of the flexible fabric portion 18 offers lower cost of manufacture when the material that is used to filter the air is especially expensive.

The bottom portion of the flexible fabric portion 18 includes a lower band 20 that passes in a circle and is contained in a first seam 22.

One end of the lower band 20 protrudes through an opening in the first seam 22 and may be grasped and pulled by the wearer to tighten the bottom of the flexible fabric portion 18 around the neck.

The lower band 20 is formed of any desired cord-like material however, it is preferably elastic (i.e., able to stretch) for increased comfort.

An upper band 24 includes a first end 24*a* that passes through the first hole 16*a* of the shield portion 12 and enters into a second seam 26.

The second seam 26 passes around a back portion, identified in general by the reference numeral 28, of the flexible fabric portion 18. The second seam 26 is disposed above the first seam 22 at the back portion 28 of the flexible fabric portion 18 and is generally in a parallel relationship with respect to the first seam 22 at the back portion 28.

The second seam 26 continues up the flexible fabric portion 18 on the remaining side thereof. The upper band 24 that is contained throughout the length of the second seam 26 exits from the second seam 26.

The FIG. 1 drawing shows a modified embodiment on the right side thereof. Before discussing the modified embodiment, it is helpful to note that a second end 24*b* of the upper band 24 would normally exit through the second hole 16*b* in the shield portion 12 in a manner that is symmetrical to that of the left side. The shield portion 12 extends in a single piece across the entire face mask 10.

In use, after placing the lower portion of the flexible fabric portion 18 over the head and around the neck of the wearer, the upper portion is raised over the face so as to align the shield portion 12 over the eyes. When this is accomplished the curved bottom of the shield portion 12 and the seal 14 are also aligned over the nose area of the wearer.

The wearer then pulls, either simultaneously or alternately, on the first and second ends 24*a*, 24*b* of the upper band 24 in order to apply pressure to the seal 14 and to secure the shield portion 12 in position on the face of the wearer. The fist and second holes 16*a*, 16*b* are small enough so as to supply the necessary resistance to the upper band 24 to keep it in the position it is set to.

If it is desired, the face mask 10 can be worn with the back portion 28 securing it around the neck and the rest of the mask hanging down in front of the wearer. This is considered to be a "passive" position and is useful and provides an especially comfortable and convenient way to transport the face mask 10 with the wearer when it is not in use. When needed for use (i.e., to go to an "active" position) it is simply lifted and secured in a manner as is described in greater detail hereinafter.

Referring now primarily to the right portion of the FIG. 1 drawing, is shown a modified embodiment of the face mask 10 that includes a detachable lens portion 50.

The detachable lens portion 50 normally extends across the entire face mask 10 as a single piece and it also contains the first and second holes 16*a*, 16*b* through which pass the first and second ends 24*a*, 24*b* of the upper band 24.

The modified embodiment includes a nose bridge assembly 52 (only the right side thereof is shown in the FIG. 1 drawing) that extends across the front of the face mask 10. The seal 14 is attached to the nose bridge assembly 52 and also extends across its length.

The flexible fabric portion 18 is attached to the nose bridge assembly 52 according to the modified embodiment (instead of being attached directly to the shield portion 12).

The nose bridge assembly 52 includes a third hole 54 and a fourth hole (not shown) each of which align under the first and second holes 16*a*, 16*b* of the detachable lens portion 50.

When the modified embodiment of the face mask 10 is used, the detachable lens portion 50 is used as an eye shield. This is accomplished by pulling on the first and second ends 24*a*, 24*b* of the upper band 24 while simultaneously pushing the detachable lens portion 50 toward the face of the wearer until it is disposed directly over the nose bridge assembly 52.

There are two primary advantages that are provided by the modified embodiment.

The third and fourth holes 54 provide the necessary resistance, independent of the detachable lens portion 50, to secure the upper portion of the flexible fabric portion 18 generally, and the nose bridge assembly 52 in particular, to the wearer.

This permits the wearer to pull the detachable lens portion 50 forward away from the nose bridge assembly 52 and closer toward the first and second ends 24*a*, 24*b* of the upper band 24.

The detachable lens 50 is then permitted to hang in front of the wearer. This is the first significant advantage of the modified embodiment and it is especially useful when it is desired that the face mask 10 is needed to filter the air or to provide hearing protection, as is described in greater detail hereinafter, or both, but not eye protection. Some wearers do not like looking through any sort of a lens unless it is required for safety.

The ability to use the face mask 10 without having to look through the detachable lens 50 makes wearing the face mask 10 especially comfortable. It also allows the wearer to use only those modalities of protection (i.e., either filtering the air with or without hearing protection and with or without eye protection, or just hearing protection with or without filtering the air or with or without the combination of filtering the air along with eye protection).

When the wearer desires eye protection, this is accomplished by simply pulling on the first and second ends 24*a*, 24*b* of the upper band 24 while simultaneously pushing the detachable lens portion 50 toward the face of the wearer until the detachable lens portion 50 is disposed in front of the eyes and directly over and adjacent to the nose bridge assembly 52.

The second advantage of the modified embodiment is that the detachable lens portion 50 can be readily replaced by first removing it from the face mask 10 by pulling it completely off of the first and second ends 24*a*, 24*b* of the upper band 24. Replacement of the detachable lens 50 is then accomplished by inserting the first and second ends 24*a*, 24*b* through the first and second holes 16*a*, 16*b* of a replacement lens (not shown) and securing the replacement lens over the nose bridge assembly 52 in a manner as was described hereinabove for the detachable lens portion 50.

Attached to the left side and to the right side of the face mask 10 is a first end each of a first tether 56 and a second tether 58, respectively. The first and second tethers 56, 58 are attached where desired to the face mask 10. A preferred attachment location for the tethers 56, 58 is to the flexible fabric portion 18 generally, and more particularly, they pass through the flexible fabric portion 18 and enter into the upper seam 24 where they are secured.

Attached to an opposite end each of the first tether 56 and the second tether 58 are a first ear plug 60 and a second ear plug 62, respectively.

As desired, when using either the basic version of the face mask 10 or the modified embodiment thereof, the first and second ear plugs 60, 62 are inserted into the ears of the wearer to reduce the level of sound energy that the wearer's ears are exposed to.

It is important also to realize that the flexible fabric portion 18 provides general protection as well to a large area of the face of the wearer in that it prevents direct impact from occurring. This is useful to prevent paints and other substances, for example, cleaning products, from splashing onto the face of the wearer.

Accordingly, the face mask 10 provides a variety of combinations of ear, eye, face protection as well as filtering the air of particulants.

An ear 63 of the wearer is shown in dashed lines in the FIG. 2 drawing to illustrate that no part of the flexible fabric portion 18 need pass over or above the ear 63. As such the mask 10 eliminates the need for any kind of a strap above the ear 63 in order to secure it in position.

There are also times when the detachable lens 50 is not needed at all. At such times, the nose bridge assembly 52 is used without the detachable lens 50.

The modified embodiment of the face mask 10, when used without the detachable lens 50, provides filtering of the air and, if the ear plugs 60, 62 are used, protection from loud noises but no eye protection. A low cost version of the face mask 10 is, accordingly, provided.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

For example, other types of material can be used to provide the flexible fabric portion 18 other than cloth fabrics. For example, a woven screen type of fabric can be used to form the flexible fabric portion 18.

According to a further modification, is desirable to be able to separate the back portion 28 of the flexible fabric portion 18 in half so as to permit easier application of the face mask 10 about the neck of the wearer and faster and easier removal, especially during times of emergency.

To accomplish this, the back portion 28 is cut vertically and a first portion of a hook and loop fastener 64, such as is sold under the tradename VELCRO, is attached to one end of the back portion 28 and a second remaining portion of the hook and loop fastener 64 is attached to the remaining end of the back portion 28.

The first and remaining ends are either pressed together to secure the face mask 10 about the neck of the wearer or pulled apart to quickly remove it, as desired.

The upper and lower bands 20, 24 are also each cut in half and secured to the back portion 28 where it has been vertically cut in half.

According to another possible modification the flexible fabric portion 18 if formed of cloth or paper, thereby providing a version of the mask 10 that is disposable and very economical to produce. The mask 10 can also then be provided in a sterile version that is of use to health care professionals, such as doctors, surgeons, dentists, nurses, and the like.

For example, it is also possible to attach and remove the detachable lens by the use of VELCRO. Similarly, the nosebridge assembly 52 can be formed of any preferred material including plastics or metals, such as aluminum.

Similarly, there are many other potential applications for the face mask 10 that have not been mentioned herein, such as for use with sports or vehicles, such as all-terrain vehicles (ATV's) that are often driven off-road and in the mud. The face mask 10 can be used to protect the face from mud as well as from other substances.

What is claimed is:

1. A face mask adapted to be worn proximate a face of a user, comprising:

(a) a flexible material; and (b) means for retaining said flexible material proximate said face of said user.

2. A face mask adapted to be worn proximate a face of a user, comprising:

(a) a nose bridge that is adapted to fit the contour of a face proximate a nose of the user;

(b) a section of flexible material, a portion of said section of flexible material attached to said nose bridge; and (c) means for retaining said flexible material and said nose bridge proximate said face of said user.

3. The face mask of claim 2 wherein said nose bridge is adapted to support a shield, said shield including at least a portion thereof that is transparent.

4. A face mask adapted to be worn proximate a face of a user, comprising:

(a) a flexible material;

(b) a shield, said shield including a transparent portion and means for retaining said shield proximate to a top portion of said flexible material; and (c) means for retaining said flexible material proximate said face of said user.

5. The face mask of claim 4 wherein said flexible material includes means for removing particulants from a source of air prior to inhalation of said air by said user.

6. The face mask of claim 5 wherein said means for removing particulants includes a flexible cloth.

7. The face mask of claim 5 wherein said means for removing particulants includes a flexible screen.

8. The face mask of claim 5 wherein said means for removing particulants includes paper.

9. The face mask of claim 5 wherein said means for removing particulants includes means for blocking said particulants from passing through said flexible means.

10. The face mask of claim 9 wherein said means for blocking includes means for preventing said particulants from passing through said flexible means when a diameter of said particulants exceeds a predetermined size.

11. The face mask of claim 4 wherein said shield includes a plastic.

12. The face mask of claim 4 wherein means for retaining said shield proximate to a top portion of said flexible material includes a cord, said cord passing through at least one hole disposed in said shield and wherein static friction between said cord and said at least one hole is sufficient to maintain said shield in position with respect to said cord.

13. The face mask of claim 12 wherein said at least one hole includes a first hole and a second hole, said first hole and said second hole disposed in a spaced apart relationship through said shield and wherein a first end of said cord passes through said first hole and a second end of said cord passes through said second hole.

14. The face mask of claim 13 wherein a portion of said cord is disposed in a seam that extends along a perimeter of said flexible material.

15. The face mask of claim 12 wherein said means for retaining said flexible material proximate said face includes a plurality of cords.

16. The face mask of claim 15 wherein said plurality of cords includes an upper cord and a lower cord.

17. The face mask of claim 14 wherein said upper cord includes means for adjusting an upper portion of said flexible material with respect to said face of said user.

18. The face mask of claim 14 wherein said lower cord include means for adjusting a lower portion of said flexible material with respect to said face of said user.

19. The face mask of claim 4 wherein said means for retaining said flexible material proximate said face includes an upper cord.

20. The face mask of claim 15 wherein said upper cord is elastic.

21. The face mask of claim 4 including a seal, said seal attached to said shield and disposed intermediate said shield and said face of said user.

* * * * *